United States Patent [19]

Theurer

[11] Patent Number: 4,583,895

[45] **Date of Patent: * Apr. 22, 1986**

[54] MOBILE MACHINE FOR REMOVING SURFACE IRREGULARITIES FROM A RAIL HEAD OF A RAILROAD TRACK

[75] Inventor: Josef Theurer, Vienna, Austria

[73] Assignee: Franz Plasser Bahnbaumaschinen-Industriegesellschaft m.b.H, Vienna, Austria

[ * ] Notice: The portion of the term of this patent subsequent to Dec. 28, 1999 has been disclaimed.

[21] Appl. No.: 316,838

[22] Filed: Oct. 30, 1981

Related U.S. Application Data

[62] Division of Ser. No. 151,122, May 19, 1980, Pat. No. 4,372,714.

[30] Foreign Application Priority Data

Jan. 17, 1980 [AT] Austria ..... 248/80

[51] Int. Cl.[4] ..... B23D 1/20; E01B 31/15

[52] U.S. Cl. ..... 409/295; 409/137; 409/296; 409/298; 51/178; 29/DIG. 95

[58] Field of Search ..... 409/295, 137, 138, 296, 409/293, 298, 300, 140, 175; 29/DIG. 95; 51/178, 326

[56] References Cited

U.S. PATENT DOCUMENTS

| | | | |
|---|---|---|---|
| 1,025,754 | 5/1912 | Little | 409/319 X |
| 1,248,276 | 11/1917 | Curtis | 29/DIG. 95 |
| 4,050,196 | 9/1977 | Theurer | 51/178 |
| 4,365,918 | 12/1982 | Theurer | 409/296 |

*Primary Examiner*—Z. R. Bilinsky
*Attorney, Agent, or Firm*—Kurt Kelman

[57] ABSTRACT

Rail heads are planed with a mobile machine moving continuously along a track and comprising a frame and a rail planing tool mounting linked to the frame. The mounting is adjusted vertically relative to the running surface of the rail head and pressed thereagainst, and guided along the rail head by a guide roller laterally guiding the mounting along a selected side of the rail head and two additional guide rollers vertically guiding the mounting along the running surface of the rail head. A tool head including a tool holder is mounted on the mounting for displacement relative thereto and a rail planing tool is replaceably mounted in the tool holder and detachably carries a cutting blade having a cutting edge for planing chips or shavings off the rail head by the forward thrust of the machine. A pick-up magnet removes the chips.

7 Claims, 17 Drawing Figures

55
31
48
47
32
45
46
50
53
44
51
43
49
52
26(27)
42
34
45°
4(5)
23
37

31
48
32
46
50
37
53
51
42
44
51
4(5)

31
48
51
32
26(27)
48
42

4(5)
37

48
55
31
32
51
26(27)
53
4(5)

55
31
48
32
26(27)
51
4(5)
53

31
44
32
54
26(27)
42
43

23
4(5)
37

48
23
32
42
44
5
37
6

MOBILE MACHINE FOR REMOVING SURFACE IRREGULARITIES FROM A RAIL HEAD OF A RAILROAD TRACK

This application is a division, of application Ser. No. 151,122 filed May 19, 1980, now U.S. Pat No. 4,372,714, dated Feb. 8, 1983.

The present invention relates to a mobile rail contouring machine for removing such surface irregularities as ripples, corrugations and overflow metal from a rail head defining a gage side, a field side and a running surface during, and by the forward thrust of, the mobile rail contouring machine having a frame mounted on a railroad track for continuous movement in an operating direction, the track including two rails each having the rail head.

Known machines of this type comprise a frame, a rail contouring tool mounting linked to the frame, drive means for vertically adjusting the mounting relative to the running surface of the rail head of a respective rail and for pressing the mounting thereagainst, the mounting being guided vertically and laterally along the sides and the running surface of the rail head, a rail contouring tool head including a tool holder arranged on the mounting and a rail contouring tool mounted on the tool holder. The rail contouring tool may be a rotary grinding disc or a whetstone and, where it was desired to remove the irregularities to a greater depth, a planing tool including a cutting blade.

German Pat. No. 905,984, published Mar. 8, 1954, discloses a vise clamped to a rail at a rail joint and carrying a mechanism including a tool head mounting a tool for milling the welded joint. The tool head is cranked back and forth along the running surface of the rail head to plane the joint. This device is only useful locally at respective rail joints and cannot be used for the continuous contouring of a rail of a railroad track. It is also complex in construction and use, for all of which reasons it has found no practical application. U.S. Pat. No. 4,295,764, filed Dec. 11, 1978, discloses a mobile rail contouring machine with a plurality of mountings vertically adjustably connected to the machine frame and vertically and laterally guided along the rail, each mounting carrying a number of cutting blades or whetstones. The mounting with the cutter blades affixed thereto is vertically adjustable relative to the flanged wheels supporting it on the rail so as to position the cutting blades in relation to the running surface of the rail head for milling it. The mountings associated with each rail are linked together by a hydraulic cylinder-piston unit for spreading the mountings and blocking them in position. This arrangement made it possible for the first time to obtain the continuous removal of irregularities from the running surface of the rail head with cutting or planing tools at high efficiency but it was not always possible to achieve accurate contouring to the desired profile. In addition, centering of the contouring tools and setting them properly in relation to the surface to be milled was often difficult. These inaccuracies caused rapid wear of the cutting blades.

U.S. Pat. No. 4,309,846, filed Jan. 29, 1979, discloses a mobile machine for removing surface irregularities from the gage side, field side and running surface of the rail heads of track rails. The machine frame carries three pairs of tool carriers transversely aligned with respect to the track and a respective tool carrier associated with a respective rail. Each tool carrier is vertically adjustably mounted on the machine frame and is arranged for guidance along the respective rail in a vertical and lateral direction. At least one longitudinally adjustable spacing members extends transversely to the track between the tool carriers of each pair and a pivot connects respective ends of the spacing member to the respective tool carriers. A first pair of the tool carriers carries metal cutting tools engageable with the running surfaces of the rail heads, the second pair of tool carriers carries metal grinding tools arranged to be pressed against the running surfaces, and the third pair of tool carriers carries metal shearing tools for shearing off the overflow metal at the field side of the rail heads. Guide rollers guide the tool carriers of the third pair without play along the running surfaces and field sides of the rail heads. The variety of rail head surfacing tools and the relatively complex operation thereof for removal of the surface irregularities often interferes with the accuracy of the operation required for a proper contouring of rail heads, the successive tools at time at times working at cross purposes during the pass of the machine over the track section.

In copending application U.S. Pat. No. 4,365,918 filed Apr. 21, 1980, there is disclosed a method and mobile machine which overcomes the indicated difficulties and disadvantages to a considerable extent. In the disclosed method, surface irregularities are removed from a rail head during, and by the forward thrust of, a mobile rail contouring machine having a frame mounted on a railroad track for continuous movement in an operating direction, the track including two rails each having a rail head and the machine comprising a rail planing tool mounting linked to the frame, guide roller means for vertically and laterally guiding the mounting along the rail head of a respective rail, the guide roller means including guide rollers laterally guiding the mounting along a selected rail head side and vertically guiding the mounting along the running surface of the rail head, a rail planing tool head mounted substantially centrally on the mounting for lateral and vertical displacement in relation thereto, and a single rail planing tool carrying a cutting blade mounted in the tool head. The method comprises the steps of laterally pressing the mounting against the side of the rail head of the respctive rail opposite to the side thereof from which the surface irregularities are to be removed and against the running surface of the rail head, and simultaneously continuously moving the mounting along the respective rail with a force of a sufficient thrust to plane chips or shavings off the rail head with the cutting blade.

The disclosed mobile machine comprises a frame, a rail planing tool mounting linked to the machine frame in association with each rail, the mountings being in substantial alignment in a direction extending transversely to the rails, transversely extending spacing members linking the mountings to each other, hydraulic drives for continuously adjusting the spacing members and the mountings linked thereto to the track gage, and hydraulic drive means for vertically adjusting the mountings relative to the running surface of the rail head of the associated rail and for pressing the mountings thereagainst. Guide roller means vertically and laterally guide the mountings along the rail heads of the associated rails, the guide roller means including two guide rollers laterally guiding each mounting without play along a selected side of the rail head of the associated rail and a plurality of additional guide rollers vertically guiding each mounting along the running surface of the rail head of the associated rail, the additional guide rollers each having an axis extending substantially parallel to the track plane. A tool head including a tool holder is mounted centrally between the guide rollers and for displacement in relation to the mounting in planes parallel to the track plane and to a vertical plane passing through the associated rail. Further hydraulic drives are connected to each tool head for displacing the same in these planes and a rail planing tool is replaceably mounted in the tool holder, the tool detachably carrying a cutting blade having a cutting edge for planing chips or shavings off the rail head to obtain a selected rail head configuration.

This method and machine tends to restore track rails uniformly to their original contours in a continuous operation along long stretches of track.

It is the primary object of the invention to improve this machine for practical use along extended track sections.

The above and other objects are accomplished according to the present invention by removing the chips or shavings as the machine continuously moves in the operating direction. For this purpose, the machine includes means for removing the chips or shavings.

This invention has made it possible for the first time not only to rationalize rail contouring operations in existing track sections greatly but to accomplish results which heretofor could be obtained only by removing the rails and to contour them while held in stationary vises. With the machine of the invention, the contours of rail heads can be accurately restored while moving the machine along existing tracks, with all their faults in gage and alignment, the possibility also being open to restore only sections of the rails which require contouring of their rail heads to the required quality.

The above and other objects, advantages and features of this invention will become more apparent from the following detailed description of certain now preferred embodiments thereof, taken in conjunction with the accompanying partly schematic drawing wherein.

Figure 1:
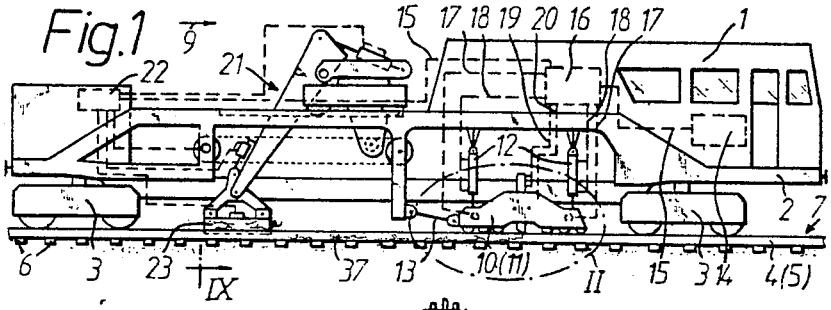
FIG. 1 is a side elevational view of a first embodiment of the mobile rail planing machine of the invention.
Figure 2:
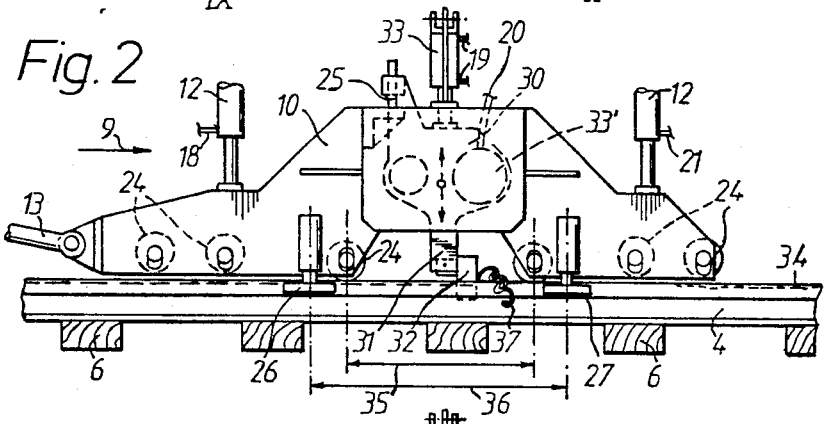
FIG. 2 is a like but enlarged view of the rail planing tool mounting in one operating mode.
Figure 3:
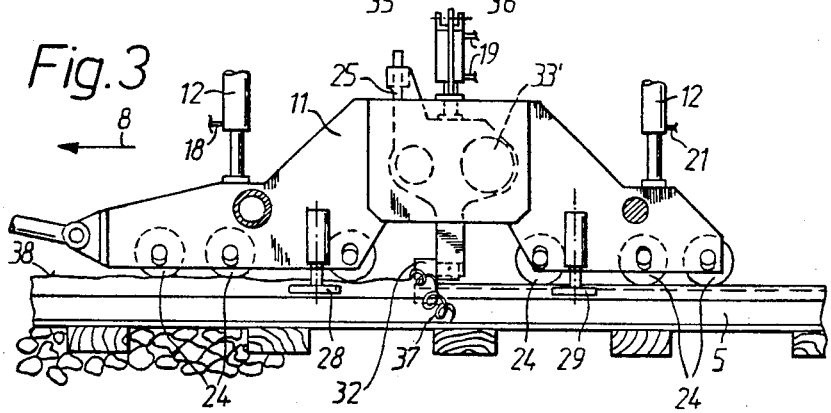
FIG. 3 shows the same view of the mounting in another operating mode and moving in the opposite direction.
Figure 4:
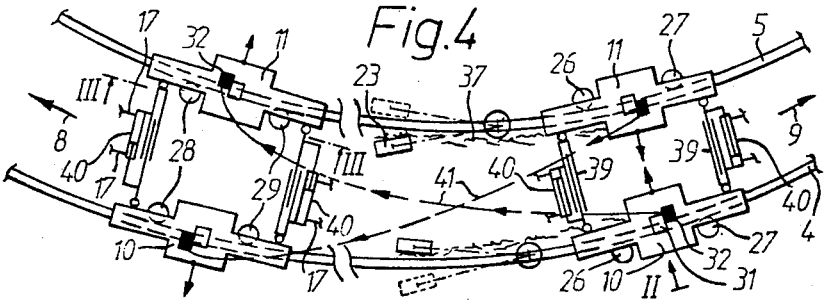
FIG. 4 is a top view of the mountings of FIGS. 2 and 3.

Referring now to the drawing and first to FIG. 1, there is shown mobile rail planing machine 1 mounted on railroad track 7 for continuous movement in an operating direction indicated by arrow 9 (see FIGS. 2, 4 and 12) or arrow 8 (FIGS. 3 or 4). The track includes ties 6 to which are fastened rails 4 and 5 each having a rail head 42 (see FIGS. 5–11) defining gage side 43, field side 44 and running surface 53. The machine is arranged for continuously removing such running surface irregularities as ripples or undulations, corrugations and overflow metal 34 during the continuous movement in the operating direction.

Rail contouring machine 1 comprises frame 2, rail planing tool mounting 10, 11 linked to the frame, and drive means constituted by hydraulic cylinder-piston motors 12 for vertically adjusting each mounting relative to the running surface of the rail head of an associated one of the rails and for pressing the mounting thereagainst. Machine frame 2 has conventional couplings at respective ends thereof to enable the frame to be incorporated into a train for movement between working sites over long distances and/or for coupling together a plurality of the machine frames to constitute a work train for contouring the rails of a track. The machine also preferably has its own drive to be self-propelled in either selected operating direction along the track, running on two undercarriages 3, 3 which are shown as double-axled swivel trucks. Connecting rod 13 extending in the direction of track 7 links one end of each mounting to machine frame 2 and th cylinder-piston motors 12 are capable of vertically adjusting the mounting and to exert a vertical loading force thereon.

Central power plant 14 is mounted on the machine frame, the power plant including, for example, a fluid pressure generator and an electric generator coupled to a Diesel motor. Furthermore, operating connection 15 connects the central power plant to control 16 for remote control of the various machine operations, conduits 18 connecting the cylinder chambers of motors 12 to the control and further conduits 17, 19 and 20 connecting the control to other mechanisms to be described hereinafter.

As indicated at II in FIG. 1, mobile machine 1 is equipped with a single rail planing tool mounting associated with each one of the rails. According to the invention and as will be described in detail in connection with FIG. 12, machine 1 comprises means 21 for removing chips or shavings 37, which includes pick-up magnet 23 displaceable for picking up the chips. In the embodiment of FIG. 1, means 21 is mounted on frame 2.

FIG. 2 shows mounting 10 which is visible in the side elevation of FIG. 1 and is associated with rail 4 while FIG. 3 shows mounting 11 associated with rail 5. As shown in FIGS. 2 and 3, guide roller means for vertically and laterally guiding each mounting along one of the rails includes guide rollers 26, 27 laterally guiding mounting 10 and guide rollers 28, 29 laterally guiding mounting 11 along a selected side 43, 44 of rail head 42 and additional guide rollers 24 vertically guiding each mounting along running surface 53 of the rail head, the additional guide rollers each having an axis extending substantially parallel to the track plane transversely of the track.

Two innermost additional guide rollers 24 in the illustrated guide roller means are spaced apart in the direction of the track by a distance not exceeding about half the gage of the track and a respective guide roller 26, 27, 28, 29 is associated with each innermost additional guide roller 24. In this arrangement, the guide rollers cooperate to constitute a rigid reference for planing overflow metal 34 (see FIG. 5) at a side 43 of the rail head opposite selected side 44 which is engaged by guide rollers 26, 27 for laterally guiding the mounting along the selected side. Rail planing tool head 30 is mounted on the mounting 10, 11 substantially centrally between the two innermost additional guide rollers 24. This very simple structure provides a very rigid vise for the rail planing tool and may be subjected to relatively high loads for effective operation of the planing tool. The centering of the tool head between the relatively closely spaced guide rollers enables the cutting blade to be applied to the rail accurately and without play, the cutting blade being rigidly held on the mounting by the tool head in whose holder the blade is mounted. In this manner, the original rail head profile may be accurately restored by first planing the overflow metal and then suitably machining the rail head to assume the original profile. In view of the shortness and rigidity of the reference basis provided by the guide rollers, this construction has the additional advantage of making it possible to provide recesses in the mounting to make the tool holder readily accessible for replacement of the tools and cutting blades. Generally, the spacing between the guide rollers wherebetween the tool head is mounted will be about 700 mm.

Further additional guide rollers 24 spaced from each innermost additional guide roller are spaced apart in the direction of the track by a distance not exceeding about the length of track ties 6. The additional guide rollers are mounted for selected positioning retracted from, and in engagement with, the running surface. In FIG. 2, further additional guide rollers 24 are shown in the retracted position while FIG. 3 shows them in the engaged position wherein the guide rollers cooperate to constitute an elongated rigid reference for planing ripples or corrugations. As shown, the axles of rollers 24 are mounted in elongated slots in mounting 10, 11 to enable them to be selectively positioned in relation to running surface 53 of the rail head.

The long rigid reference basis enables the machine to plane elongated undulations or ripples in the rail head running surface and to remove the same in the form of chip or shaving 37 as the machine moves along the track, the rail head being preferably restored to its original profile at the same time. The usual distance between the two outermost further additional guide rollers 24 will be about 2 m. This enables the length of the reference to be adjusted widely to the length of the ripples to be removed by selectively positioning respective further additional guide rollers 24. Guide rollers 26 to 29 are disc-shaped rollers rotating about vertical axes.

As shown in the drawing, rail planing tool head 30 including downwardly projecting tool holder 31 is mounted on mounting 10, 11 for displacement in relation thereto in planes parallel to the track plane and to a vertical plane passing through the associated rail. For this purpose, hydraulic cylinder-piston drive motor 33 vertically movably connects tool head 30 to the mounting and conduits 19 connect the cylinder chambers of the drive motor to control 16 for displacing the tool head vertically, limit stop means 25 limiting the vertical stroke of the tool head. Tool head 30 is laterally displaceable in relation to the mounting by hydraulic cylinder-piston drive motor 33' whose cylinder chambers are connected to control 16 by conduits 20. Any suitable guide means, such as guide columns, dove-tailed guide tracks and the like, may mount the tool head on the mounting for vertical and horizontal displacement thereof. The specific displacement means are not part of the present invention as long as the tool head may be displaced in relation to the mounting to assume a desired operating position assuring the desired cutting depth of the cutting blade. Rail planing tool 32 is replaceably mounted in tool holder 31 and the tool detachably carries cutting blade 48, 54 (FIGS. 5 to 11) having a cutting edge for planing a selected profile of rail head 42.

In the retracted position of further additional guide rollers 24 shown in FIG. 2, the machine is adapted for removal of overflow metal 34 produced by prolonged train traffic and for machining gage side 43 of the rail head, which require only short reference 35 provided by the two engaged innermost additional guide rollers 23 while all the further additional guide rollers 24 are out of contact with the running surface of the rail head. Distance 36 between the vertical axes of guide roller pairs 26, 27 and 28, 29 is also relatively small, averaging maybe about 700 mm. With this arrangement, irregularities having a wavelength of up to about 30 cm can be readily removed. As is shown in FIGS. 5 to 8, rail contouring tool 32 is positioned opposite the rail head side engaged by the lateral guide rollers so that the latter serve as a support for absorbing the lateral cutting forces. As the machine advances continuously, the cutting blade will machine a continuous chip or shaving 37 off the rail head, the mounting being continuously moved along the rail by the machine with a sufficient thrust to plane the rail head while the mounting is pressed thereagainst.

When the machine is used to remove relatively short ripples 38, as illustrated in FIG. 3, the mounting is laterally guided by guide rollers 28, 29 along gage side 43 of rail head 42 and a longer reference basis is provided by lowering further additional guide rollers 24 into engagement with the running surface of the rail head. Obviously, a larger number of vertical guidance rollers could be provided and any selected number of guide rollers 24 may be retracted to adapt the length of the reference to the length of the ripples or other irregularities to be removed and to avoid copying such surface irregularities in case the wheel base of the mounting accidentally coincides in length with the length of such irregularities. While undulations 38 are planed, rail head profiling may be produced by the cutting blades. Whether such simultaneous profiling work may be produced with a suitable cutting blade arrangement will depend primarily on the degree of wear of the rail head. As machine 1 moves in operating direction 9, pick-up magnet 23 will remove chips 37 from the track.

FIG. 4 illustrates the operation of rail planing machine 1 of FIGS. 1 to 3 in a track curve and in opposite operating directions, advancing in the direction of arrow 8 with the arrangement of FIG. 3 and in the direction of arrow 9 with the arrangement of FIG. 2. As schematically indicated in FIG. 4, a mounting 10, 11 is linked to the machine frame in association with each rail 4, 5. A tool head 30 is arranged on each mounting and a single tool 32 carrying a single cutting blade is mounted in each tool holder 31. Mountings 10, 11 are in substantial alignment in a direction extending transversely to the rails and transversely extending spacing members 39 continuously adjustable to the track gage by hydraulic cylinder-piston drive motors 40 link the mountings to each other preferably by means of universal joints. Double-acting drive motors 40 are connected by conduits 17 to control 16 for operation. These motors enable the operator of the machine, depending on the selected rail contouring operation, to apply hydraulic pressure to a selected cylinder chamber of the drive motor to press guide rollers 26, 27 of mountings 10, 11 against field sides 44 of rails 4 and 5 (right side of FIG. 4) or to press guide rollers 28, 29 against gage sides 43 of the rails (left side of FIG. 4). In both selected positions, the mountings are pressed without play against the track rails to follow the curve and, at the same time, their transverse spacing is adjusted to a changing track gage in the curve.

With a given machine weight, such a tool arrangement produces a very high rail planing force and efficiency, the adjustable spacing members linked universally to the mountings assuring at the same time that, despite the very high operating stresses, the tools are always held in a rigid vise during the cutting operation. When the weight of the machine is, for example, about 40 tons, a sufficient thrust can be reached to produce cutting forces for removing a continuous chip or shaving of a gage of the magnitude of about 0.5 mm and more as the cutting blade planes the rail head during the continuous advance of the machine along the track.

The right side of FIG. 4 shows the arrangement and operation according to FIG. 2 and planing tools 32 are mounted at the front of tool holder 31, as seen in the operating direction indicated by arrow 9. At the left side, the arrangement and operation according to FIG. 3 is illustrated for operating in the opposite direction. This change is accomplished very simply by proceeding in the manner indicated by arrows 41 to reposition tools 32, motors 40 being operated in the opposite direction to engage guide rollers 28, 29 instead of rollers 26,27.

As shown, tool holder 31 is symmetrically constructed with respect to a plane extending vertically to the track and perpendicularly to the rail whereby a respective tool may be operative in a respective operating direction of the machine. This makes it possible to use the same tool on the machine for operation in both directions along the track, requiring merely the repositioning of the tool in the holder. A few typical embodiments of rail planing tools useful for the machine to remove surface irregularities from rail heads in a continuous planing operation are illustrated in FIGS. 5 to 11.

Figure 5:
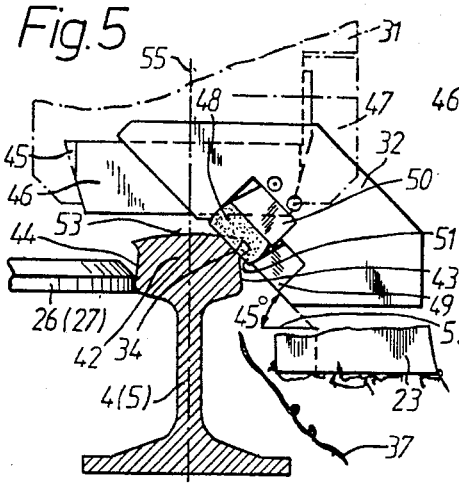
FIGS. 5 to 10 show enlarged end views of different embodiments of rail planing tools for producing different profiling operations.

Referring to FIG. 5, tool holder 31 is shown to have guide 45 which is a recess of dove-tailed cross section defined in the tool holder and extending in the direction of the track. Tool part 46 is replaceably received by dove-tailed guide recess 45 and clamping plate 47 holds tool part 46 attached to the guide. This provides a very simple construction for the rapid replacement of the planing tool while, at the same time, assuring a very rigid and secure mounting of the tool in the holder. Furthermore, after the tool holder has been suitably centered, for example with respect to the center line of the track, the tool may be replaced without the need for repositioning the tool holder. Even if the tool is not precisely set in longitudinally extending guide 45, this has no effect on the accuracy of the planing operation since the latter depends solely on the accuracy of the lateral positioning of the cutting edge in relation to the rail head.

As shown in FIGS. 5 to 11, planing tool 32 is arranged symmetrically with respect to vertical center plane 55 passing through rail head 42 and detachably carries cutting blade 48, 54 having cutting edge 51 arranged to engage a selected surface of rail head 42 for planing a selected profile of the rail head. Such a tool can be used for the successive and complete restoration of the original profile of a rail head and all that is required is to replace respective tools in the tool holder for successive planing operations, as described hereinbelow.

FIG. 5 shows a tool arrangement for planing overflow metal 34 from gage side 43 of rail head 42. In this case, guide rollers 26, 27 are engaged with field side 44 of the rail head for guiding tool holder 31 without play along the rail. Cutting blade 48 is made of a highly resistant material, such as carbide steel, and is replaceably mounted in the tool holder, being held in tool 32 by wedge 49 and clamping shoes 50 to enable the cutting blade to be readily replaced in the tool. Cutting edge 51 of cutting blade 48 is arranged to extend at an angle of 45° with respect to vertical center plane 55 and plane 52 extending parallel to the plane of the track. The cutting edge is substantially rectilinear. This arrangement permits the removal of relatively much overflow metal and rectilinear cutting edges can be readily sharpened. As will be appreciated from the drawing, the removal of overflow metal 34 will produce a sharp edge in the transition between running surface 53 and gage side 43 of rail head 42. This will be properly contoured in a subsequent planing operation, as will be described hereinafter. Planed off chips 37 ar e picked up by magnet 23 positioned at the gage side of the rail head.

Figure 6:
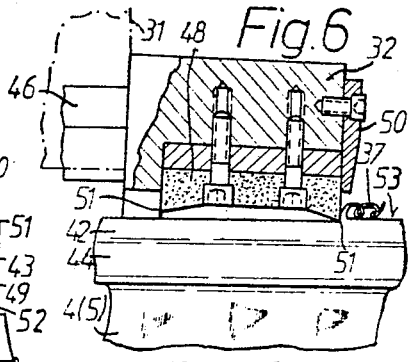

In the embodiment shown in partial longitudinal section in FIG. 6, cutting blade 48 is detachably affixed to planing tool 32 by screws and is comprised of a carbide metal platelet having two edges 51 at respective ends thereof, the platelet extending in the direction of rail head 42 and cutting edges 51 extending transversely thereto. As shown, the tool is slightly inclined with respect to running surface 53 of the rail head so that only the front cutting edge engages the running surface to remove continuous chip or shaving 37 therefrom during operation of the machine. When this cutting edgeis worn, the cutting blade is simply reversed in the tool so that the sharp edge engages the running surface. This in practice doubles the life of the blade when the two cutting edges 51 are of the same configuration. On the other hand, if they are of different configurations, reversal of the cutting blade makes it possible to use the same blade for two machining operations producing different configurations.

Figure 7:
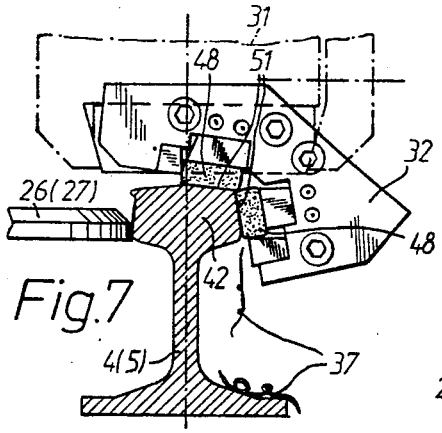

FIG. 7 shows an embodiment wherein planing tool 32 carries two cutting blades 48 at one side of vertical center plane 55. Cutting edge 51 of one cutting blade is arranged to extend at an angle of about 22.5° and the cutting edge of the other blade is arranged to extend at an angle of about 67.5° with respect to the vertical center plane, cutting edges 51, 51 enclosing an angle of about 135° and being substantially rectilinear. This tool is preferably used after overflow metal 34 has been removed with the tool illustrated in FIG. 5 so that any edges remaining after the preceding planing operation are machined by the deeper milling of the surface regions adjacent the overflow metal. At the same time, gage side 43 and half of running surface 53 of rail head 42 are planed.

Figure 8:
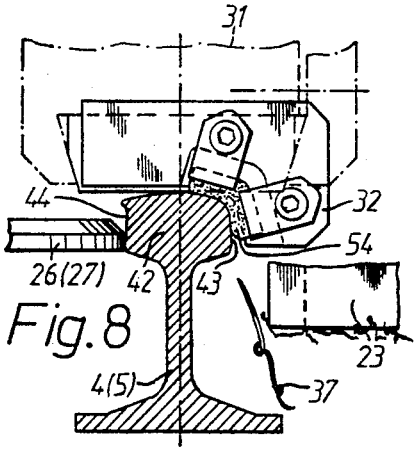

Cutting blade 54 of tool 32 of FIG. 8 has a cutting edge with a curvature substantially corresponding to the original profile of a respective side of rail head 42 including an arcuate transition region between the rail head side and the running surface of the rail head as well as an adjacent portion of the running surface. When this tool is used subsequently to the tools of FIGS. 5 and 7, the original profile of one half of the rail head is fully restored. Magnet 23 picks up chips or shavings 37 planed off by cutting blades 48 and 54 during respective passes of machine 1 in opposite operating directions.

According to a preferred embodiment of the present invention, mounting 10, 11 is continuously moved along a section of associated rail 4, 5 in three successive operating stages. Tool head 30 is displaced at the beginning of each operating stage into engagement with the rail head surface and the operating stages successively comprise a first stage for planing overflow metal 34 at gage side 43 off rail head 42 opposite field side 44 against which the mounting is pressed. Cutting blade 48 of FIG. 5 is used in this first stage and its cutting edge 51 removes the overflow metal in chips or shavings 37. in a second stage, ripples or corrugations are removed from the surface and gage side 43 during a continuous return movement along this rail section with two cutting blades at this side of vertical center plane 55, arranged in the manner shown in FIG. 7. In a third stage, contouring of one half of the rail head surface is finished with cutting blade 54, shown in FIG. 8, and chips 37 are removed.

This three-stage contouring method enables the surface of a rail head of a laid rail to be restored to an excellent operating contour in a relatively short time, the cutting blades being changed between the operating stages one of which is effected during the return movement over the track section at which the overflow metal has been removed from the rail heads. If both rails of the track are contoured at the same time in each operating stage, the contoured rails may be removed after the planing operation has been completed and these contoured rails may be exchanged in the track whereby the contoured field sides of the rails become the gage sides engaged by the flanges of the wheels of railroad cars traveling thereover.

In track curves, extensive and expensive restoration work is avoided by pressing one of the mountings of the machine against the gage side of one of the rails with which it is associated while the other mounting is pressed against the field side of the other rail for simultaneously removing the surface iregularities at the field side of the one rail and the gage side of the other rails, as shown in FIG. 4.

Figure 9:
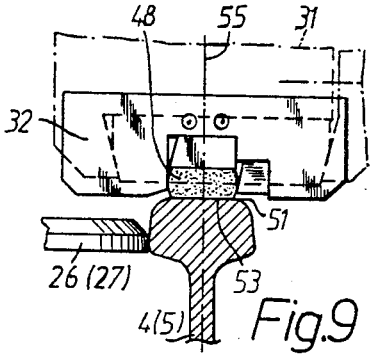

In the tool of FIG. 9, cutting edge 51 of blade 48 is arranged to extend substantially perpendicularly to the vertical center plane of the rail head and is substantially bisected thereby, the cutting edge being substantially rectilinear. This tool will be particularly useful in removing such running surface irregularities as ripples or undulations before contouring the rail head in the above-described three-stage operation.

Figure 10:
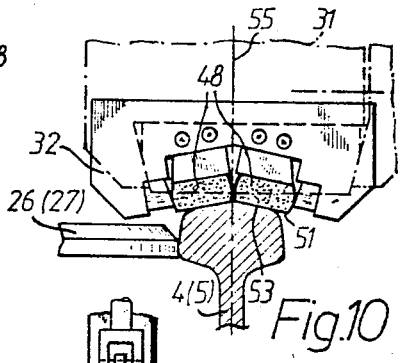

FIG. 10 shows a tool carrying two cutting blade 48, 48 arranged symmetrically with respect to vertical center plane 55 and the plane passing centrally therebetween. Cutting edges 51 of the cutting blades are arranged to extend at an angle of aout 10° to 15° with respect to the vertical center plane and are substantially rectilinear. This tool enables the entire running surface 53 of the rail head to be planed as a stage subsequent to planing with the tool of FIG. 9 and before the full restoration of the original rail head configuration which may be accomplished with the tools illustrated in FIGS. 5, 7 and 8. The chips or shavings removed by the tools of FIGS. 9 and 10 are peferably picked up by maagnet 23 in the subsequent operating stages.

Figure 11:
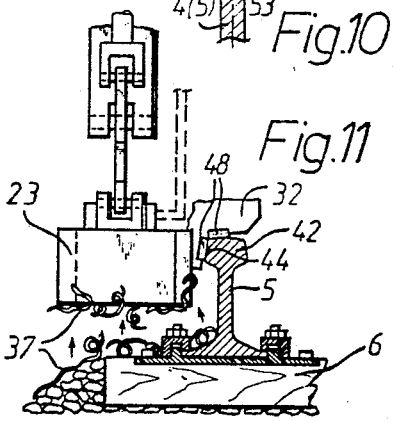
FIG. 11 is a similar view showing some details of the means for removing the chips or shavings.

FIG. 11 shows lowered pick-up magnet 23 in another operating phase for removing shavings 37 at field side 44 of rail head 42, in contrast to the position of the magnet in the operating phase shown in FIG. 5 where the shavings are removed adjacent gage side 43. In this operating phase, blades 48 in planing tool 32 have been reversed from the position illustrated in FIG. 7, the tool having been changed in accordance with the diagram of FIG. 4 along arrow 40 from the gage side of rail 4 to the field side of rail 5.

Figure 12:
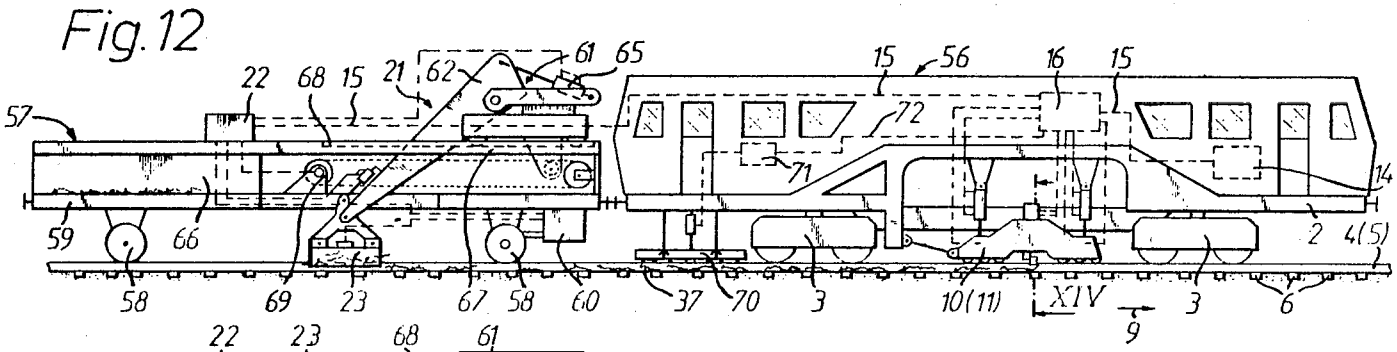
FIG. 12 is a side elevational view of another embodiment of a mobile rail planing machine.

In the embodiment of FIG. 12, means 21 for removing the chips or shavings is mounted on self-propelled machine 57 which is separate from, but coupled to, machine 56 which carries mountings 10 and 11 for the planing tools. The planing tool and general arrangement is otherwise identical with that of the embodiment shown in FIG. 1 and like reference numerals are used to designate like parts functioning in a like manner to avoid redundancy in the description. In this embodiment, independent machine 57 carrying pick-up magnet 23 can be coupled to planing machine 56 at either end or may follow machine 56 at either end, the means for removing the chips or shavings being powered and controlled from power source 14 and control 16 by suitable connections functionally equivalent to the operating arrangement described hereinabove in connection with the first-described embodiment and as illustrated in FIG. 12.

Self-propelled machine 57 comprises frame 59 supported on the track on undercarriages 58, 58 wherebetween means 23 for removing the chips or shavings is arranged. The machine has its own power source 60 which serves not only to supply power to drive the machine but also is connected to means 21 via control 22 for operating the means for removing the chips or shavings. As in the embodiment of FIG. 1, connection 15 connects control 22 to central control 16 to make it possible to operate machines 56 and 57 together.

Figure 13:
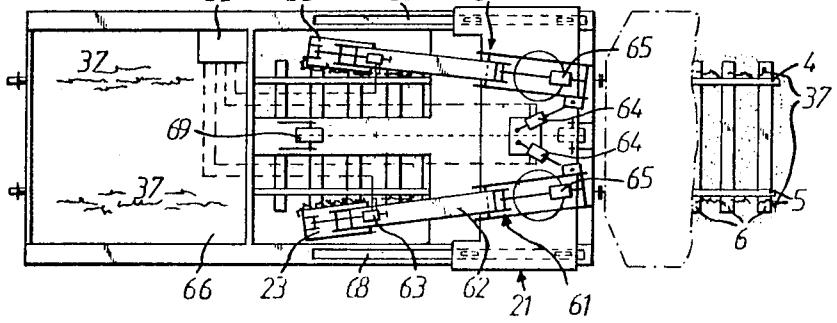
FIG. 13 is a top view of a portion of the machiine of FIG. 12 showing the means for removing the chips.

As fully shown in FIGS. 12 and 13, illustrated means 21 for removing the chips or shaving produced by the planing machine comprises a respective pivotal crane 61 associated with each rail head, the cranes being mounted rotatably on a carriage for pivoting about a vertical axis. Each crane comprises boom 62 on whose outer end pick-up magnet 23 is suspended for free pendulum movement about a horizontal axis. Hydraulic drive 63 on boom 62 is linked to the freely suspended mount for the magnet to enable the magnet position to be adjusted. Further hydraulic drives 64 on the crane carriage are linked to cranes 61 to pivot the cranes in a plane parallel to the track plane and additional hydraulic drives 65 are linked to the booms of the cranes to enable the booms to be vertically adjusted. In this manner, pick-up magnets 23 are displaceable not only vertically but transversely to the track for being selectively positioned at the gage or field side of the rail heads with which the magnets are associated. Means 21 further comprises receptacle 66 mounted on frame 59 for receiving picked chips or shavings 37 from magnets 23 and for storing the same. As shown in the preferred embodiment illustrated herein, side walls 67 of receptacle 66 carry longitudinally extending guide means 68, 68 for moving the carriage of cranes 61 along frame 59 in the direction of the track. Chain drive means 69, 69 are arranged for moving the cranes in this direction.

The highly efficient and effective rail planing machine hereinabove described not only provides a highly economical rail contouring operation which enables rail heads to be restored to their original profile in place but also immediately removes the metal chips and shavings resulting from the operation so tha the contouring operation may be effected during brief train intervals and there is no danger that trains passing over the newly restored rails will cause damage to the rail heads due to the presence of chips or shavings being ground into the rail head surfaces by the passing wheels of the trains.

The ready adjustability of the position of the pick-up magnet enables the chips or shavings to be removed and stored without problems and in every operating phase of the planing operation. In cooperation with the storage receptacle, the arrangement is designed to remove all chips or shavings continuously as the machine advances and to store them efficiently. At the same time, this efficient arrangement is very compact and simple.

The illustrated pick-up magnet has the shape of a relatively narrow beam extending in the direction of the track and having a length corresponding at least to the width of a crib. This enables chips or shavings to be picked up without problems along an extended range. If the magnetic beam is pivoted slightly with respect to the track elongation, its effective pick-up range will extend beyond its width in a transverse direction.

FIG. 12 also schematically shows vertically adjustable measuring device 70 mounted on frame 2 for measuring the respective rail heads after they have been planed and as the machine advances in the operating direction. Measuring device 70 is connected to control 71 and line 72 connects this control to central control 16 for recording the rail head measurement. This continuous measurement enables fine adjustment of the cutting blades before each operating pass in accodance with the recorded measurements so as to assure a most accurate restoration of the rail head configuration.

Deformations and wear of the rail head surfaces of track rails are caused by various conditions and each such deformation of the original rail head configuration can be eliminated by a suitable planning operation according to the present invention.

The most common types of deformation and wear are:

(A) overflow metal 34 at th field and gage sides of the rail head;

(B) worn and deformed rail head edges engaged by the flanged wheels of trains;

(C) metal fatigue on the running surface due to excessive loads;

(D) ripples on the running surface with short wavelengths of about 3 to 8 cm; and (E) undulations or corrugations on the running surface with longer wavelengths of about 8 to 210 cm.

This enumeration of different types of deformations indicates that different operations are required for restoring the rail head configuration. Faults (A) and (B) can be eliminated only by removing considerable amounts of metal along the edge of the rail head. Elimination of fault (C) also requires the removal of large amounts of metal since all zones suffering from metal fatigue must be removed. In addition, this operation restores the rail head configuration. Ripples (D) can be eliminated with the removal of relatively small amounts of metal and often requires no change in the existing rail head profile. The depth of undulations or corrugations (E) may range from tenths of millimeters to about 3 mm and their elimination requires considerable metal removal in a longitudinal and vertical direction. Faults (A) and (B) often are encountered in combination with ripples and undulations.

A better understanding of the various operating possibilities according to the invention will be gained from a consideration of FIGS. 14 to 17.

Figure 14:
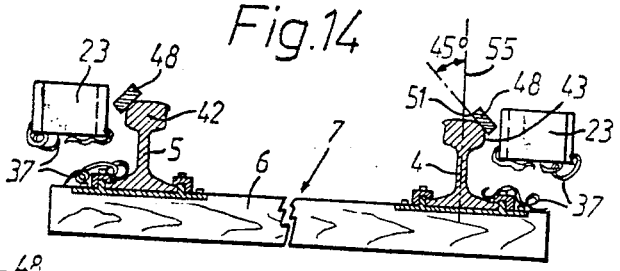
FIG. 14 is a diagrammatic section along line XIV of FIG. 12.
Figure 15:
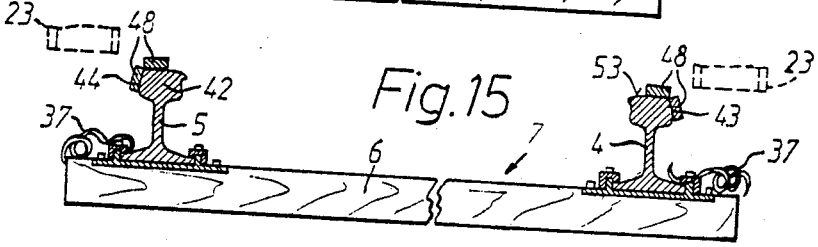
FIGS. 15 and 16 are like sections showing different operating phases.
Figure 16:
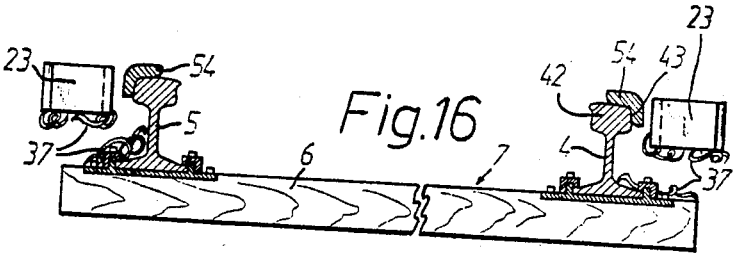

The schematic illustrations of FIGS. 14 to 16 show the machine of FIG. 1 or 12 (which are functionally equivalent) in operation when moved along track 7. A front pair of mountings, as seen in the operating direction, carries cutting blades 48 in an arrangement designed to plane overflow metal 34 at field sides 44 of rails 4 and 5, such a tool arrangement being illustrated in FIG. 5 (as applied to gage side 43). The succeeding pair of mountings carries pairs of cutting blades 48, 48 (see FIG. 7) for working in the manner of FIG. 15 while FIG. 16 shows the last pair of mountings with cutting blades 54 according to FIG. 8. In this manner, a single pass will produce not only removal of the overflow metal on the field sides of both rails but will also restore the outer half of the rails to their original profile. A second pass will then produce the same result on the other half of the rail heads.

Figure 17:
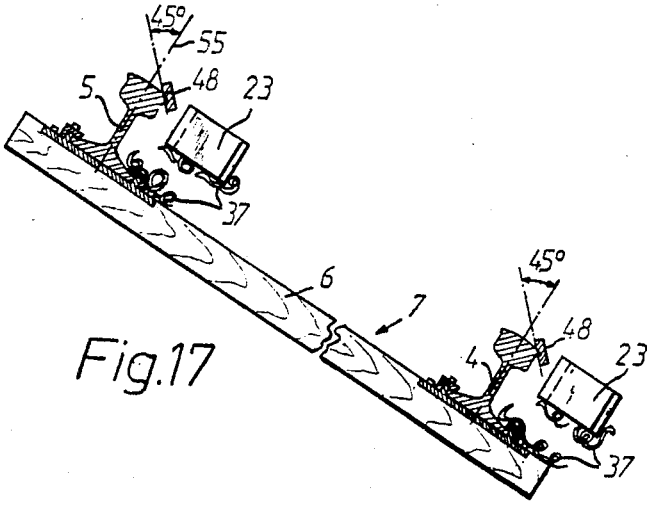
FIG. 17 is a like section of a tool arrangement set for working on the rail heads of a superelevated track curve.

FIG. 17 shows the work in a curve whose superelevation is illustrated in exaggerated form. Cutting blades 48 are so arranged with respect to respective rail heads 42 of rails 4 and 5 that the overflow metal at the inside of the curve of both rails is removed (see FIG. 5).

Various operations which may be effected with either illustrated embodiment of a mobile rail planing machine according to this invention will be described hereinbelow in more detail, these operations being possible with unitary machine 1 which has a common frame 2 carrying rail planing tool mountings 10 and 11 as well as means 21 for removing the planed off chips or shavings or with planing machine 56 which has a separate frame carrying the rail planing tools and self-propelled machine 57 coupled to the front or rear of machine 56 and carrying means 21. In either case, the rail planing tool mountings are continuously moved along the rails with a force of a sufficient thrust to plane chips or shavings off the rail head with the cutting blades and the chips or shavings are removed as the machine continuously moves in the operation direction.

PLANING THE RAIL HEAD EDGE

Overflow metal or deformations (A) and (B), above, can be eliminated according to a preferred method by continuously moving mountings 10, 11 along a section of rails 4, 5 in three successive operating stages, tool head 30 with planing tool 32 being displaced at the beginning of each operating stage into engagement with the surface of rail head 42. The operating stages successively comprise:

(a) A first stage for planing overflow metal 34 off the side (43 or 44) of the rail head opposite the side against which mounting 10, 11 is pressed in the form of continuous chips or shavings. As shown in FIGS. 5 and 14, cutting blade 48 has cutting edge 51 arranged to extend at an angle of about 45° with respect to vertical center plane 55 passing through rail head 42 and the cutting edge is substantially rectilinear. As overflow metal 34 is planed off, chips or shavings 37 are continuously removed by pick-up magnet 23 and are placed by the magnet into receptacle 66.

(b) In the second stage, the machine is moved back over the track sectioon just worked in stage (a) to remove ripples or corrugations from running surface 53 and the side (43 or 44) at which the overflow metal has been removed. Tool 32 carries two cutting blades 48, see FIGS. 7 and 15, at this side of vertical plane 55, one cutting blade having a cutting edge arranged to extend at an angle of about 22.5° and the other cutting blade having a cutting edge arranged to extend at an angle of about 67.5° with respect to the vertical plane.

(c) In the third stage illustrated in FIGS. 8 and 16, one half of the rail head surface is contoured by planing off continuous chips or shavings at this side. Cutting blade 54 has a cutting edge of a curvature substantially corresponding to the profile of the half of the rail head surface including an arcuate transition region between the rail head side and the running surface of the rail head. The continuous chips or shavings produced during stages (b) and (c) are preferably removed in the latter stage.

During these operating stages, mounting 10 and 11 may be operated with a relatively short rigid reference basis, such as shown at 35, 36 in FIG. 2, or a longer rigid reference basis may be selected for removing ripples by engaging the outermost guide rollers 24 with the rails. The chips or shavings are removed during at least one stage of the operation.

PLANING OF THE RUNNING SURFACE (WITH PRELIMINARY STAGES)

Metal fatigue (c) and undulations or corrugations (E), above, can be eliminated preferably in the manner shown in FIGS. 9 or 10. This work is done in preliminary operating stages, preferably in a forward and a return pass, after which the previously described procedure is used to effect the final configuration of the rail heads, as indicated in FIGS. 14, 15 and 16, always followed by removal of the chips or shavings. This combined operation restores the rail heads to their original profiles in a longitudinal and transverse direction.

CONFIGURATING THE ENTIRE RAIL HEAD

In many instances, it is necessary to configurate the entire rail head, i.e. not only the edges of rail head 42 but also running surface 53 thereof. This is effected in accordance with the present invention in a total of six operating stages, i.e., as shown in FIGS. 14–16, field sides 44 are first continuously worked with the tool arrangements shown in FIGS. 5, 7 and 8 (forward pass-return pass-forward pass), chips or shavings 37 being removed during the first and/or the third stage of this step. Subsequently, gage sies 43 are worked in the same manner, the chips or shavings being preferably removed during the last stage. This operation fully restores the profile of the rail head in only six stages, eliminating the necessity of removing the rails from the track for configuration in the shop and while clamped in a stationary vise.

According to another particularly useful embodiment according to the invention, which is illustrated in FIGS. 4 and 17, mountings 10 and 11 are so arranged in association with respective track rail 4 and 5 that field side 44 of rail 4 and gage side 43 of rail 5 are worked simultaneously, chips or shavings 37 being removed at the same time. This embodiment is particularly useful in track curves.

Whatever particularly method of planing is used to meet the surface conditions of the rails, it will be advantageous to measure the planed rail heads with measuring device 70 and to record the surface measurements. Also, to avoid faults at the engagement of the cutting blades with, and their disengagement from, the rail heads being planed, it is preferred to displace the tool head for engagement and disengagement of the tool during the continuous movement of the machine in the operating direction, preferably at a relatively high forward speed.

CONFIGURATION AND CHANGE OF THE RAILS

The major problem in track curves is the presence of considerable overflow metal 34 at field sides 44 of the rails and considerable wear of the inside edge of the rail head engaged by the flanged wheels of passing train cars. Heretofore, the rails in such track sections had to be removed to enable the rails to be restored to their original profile in the shop where they were clamped in stationary vises for suitable grinding or planing. These restored rails or new rails then had to be installed in these track sections. This costly and time-consuming procedure can be avoided with the present invention by simultaneously planing field sides 44 of rails 4 and 5 of track 7 while removing the chips or shavings, whereupon the rails are detached from ties 6 and exchanged so that the configurated field sides of the rails become the gage sides. The economy of this procedure is obvious.

Remote control of all operations is possible by the provision of central power plant 14 and control 16 connected to the various drive means for vertically adjusting the mountings, for displacing the tool head in relation to the mounting and for laterally pressing the mountings against the rail heads. This enables rapid adjustments by a single operator and no further monitoring personnel need be used.

Those skilled in the art will appreciate that the present invention is not limited to the specific embodiments herein described and illustrated. Thus, the lateral guide rollers may have vertical axes extending not parallel to vertical center plane 55 of the rail heads but at an acute angle thereto. Their peripheries engaging the sides of the rail heads may take any desired configuration, including cylindrical, conical or differently curvilinear. The number of guide rollers may also differ from that shown and may be increased, for instance, for added adjustability of the reference basis. Furthermore, the various guides and drives for the tool head in horizontal and vertical directions may take any suitable form, as may the structure of the tool holder and the detachable mounting of the tool in the holder.

What is claimed is:

1. A mobile rail planing machine mounted on a railroad track for continuous movement in an operating direction, the track including two rails each having a rail head defining a gage side, a field side and a running surface, the gage and field sides extending from the running surface to a lower edge of the rail head, the machine being arranged for continuously removing such surface irregularities as ripples, corrugations and overflow metal during the continuous movement and comprising (a) a frame running on the track on undercarriages having flanged wheels engaging the gage and field sides in a zone adjacent the running surface, (b) a rail planing tool mounting linked to the machine frame in association with each rail, (1) the mountings being in substantial alignment in a direction extending transversely to the rails, (c) transversely extending spacing members linking the mountings to each other, (d) hydraulic drives for continuously adjusting the spacing members and the mountings linked thereto to the track gage, (e) hydraulic drive means for vertically adjusting the mountings relative to the running surface of the rail head of the associated rail and for pressing the mountings thereagainst, (f) guide roller means for vertically and laterally guiding the mountings along th rail heads of the associated rails, the guide roller means including (1) two guide rollers laterally guiding each mounting without play along a selected one of the sides of the rail head of the associated rail and engaging the selected rail head side in a region extending from the lower edge to below the zone adjacent the running surface, and (2) a plurality of additional guide rollers vertically guiding each mounting along the running surface of the rail head of the associated rail, the additional guide rollers engaging the running surface and each having an axis extending substantially parallel to the track plane, (g) a tool head including a tool holder, the tool head being mounted centrally between the guide rollers and for displacement in relation to the mounting in planes parallel to the track plane and to a vertical plane passing through the associated rail and the tool holder including clamping means, (h) further hydraulic drives connected to each tool head for displacing the same in said planes, (i) a rail planing tool replaceably mounted in the clamping means of the tool holder, thetool holder detachably carrying (1) a cutting blade having a cutting edge for planing chips or shavings off the rail head to obtain a selected rail head configuration, and (j) means for removing the chips or shavings.

2. The mobile rail planing machine of claim 1, wherein the means for removing the chips or shavings comprises a vertically adjustable pick-up magnet, the magnet being displaceable transversely to the track for being selectively positioned at the gage or field side of the rail head with which the magnet is associated.

3. The mobile rail planing machine of claim 2, wherein the means for removing the chips or shavings comprises a respective one of the pick-up magnets associated with each rail head, and further comprising a receptacle for receiving the picked up chips or shavings from the magnets and for storing the same.

4. The mobile rail planing machine of claim 2 or 3, further comprising a pivotal crane mounted on the frame and supporting the pick-up magnet for vertically adjusting and transversely displacing the magnet, a longitudinally extending guide means for moving the crane in the direction of the track, and a drive means for moving the crane in said direction.

5. The mobile rail planing machine of claim 2 or 3, wherein the pick-up magnet has the shape of a relatively narrow beam extending in the direction of the track and having a length corresponding at least to the width of a crib.

6. The mobile rail planing machine of claim 1 or 2, wherein the means for removing the chips or shavings is mounted on the frame of the machine.

7. The mobile rail planing machine of claim 1 or 2, further comprising a self-propelled machine, the means for removing the chips or shavings being mounted on the self-propelled machine.

* * * * *